US005761919A

United States Patent [19]

Wilson et al.

[11] Patent Number: 5,761,919

[45] Date of Patent: Jun. 9, 1998

[54] ICE DETECTION SYSTEM

[75] Inventors: Larry E. Wilson, Marion; Craig R. Knotts, Fort Wayne, both of Ind.

[73] Assignee: Carrier Corporation, Syracuse, N.Y.

[21] Appl. No.: 773,247

[22] Filed: Dec. 23, 1996

[51] Int. Cl.[6] ..... F25C 1/12

[52] U.S. Cl. ..... 62/138; 62/139

[58] Field of Search ..... 62/139, 140, 128, 62/129, 151, 138, 130; 340/580

[56] References Cited

U.S. PATENT DOCUMENTS

| | | | |
|---|---|---|---|
| 3,496,733 | 2/1970 | Parker et al. | 62/139 |
| 4,121,433 | 10/1978 | Pomerantz | 62/140 |
| 4,344,293 | 8/1982 | Fujuwara et al. | 62/129 X |
| 4,347,709 | 9/1982 | Wu et al. | 62/140 |
| 4,497,179 | 2/1985 | Iwans | 62/139 X |
| 4,823,556 | 4/1989 | Chesnut | 62/139 |

*Primary Examiner*—Harry B. Tanner

[57] ABSTRACT

A system for detecting the formation of ice on a cold surface includes an electrical circuit for sensing the electrical responsiveness of a capacitor formed by a conductive plate positioned opposite the cold surface. The ice formed on the cold surface will eventually comprise most of the dielectric medium between the conductive plate and the cold surface thereby providing a distinctively recognizable electrical response that is sensed by the electrical circuit.

15 Claims, 2 Drawing Sheets

ICE DETECTION SYSTEM

BACKGROUND OF THE INVENTION

This invention relates to the detection of the formation of ice on a cold surface. In particular, this invention relates to the detection of a predetermined amount of ice on a cold surface such as may be found within an automatic ice making machine.

The detection of the formation of ice cubes in an ice making machine has heretofore been accomplished by a variety of means including mechanical apparatus, temperature measurement, and electrical resistance. In an automatic ice making machine, cold water is caused to flow over a chilled plate which is patterned with the desired shape of the ice. As the water freezes, the ice thickens and builds out from the chilled surface. Mechanical ice detectors are generally microswitches that are operated when the ice builds out enough to touch the switch actuator. Thermal ice detectors are placed such that the ice builds out and contacts the sensor presenting a unique thermal signature to the detector. The electrical resistance method uses a pair of probes placed such that the chilled water flowing over the ice forming plate forms a semiconducting bridge between the probes when the ice builds out and forces the water into contact with the probes.

The mechanical method suffers from mechanical problems such as ice sticking to the actuating surfaces, switch hysteresis and tolerances. The thermal detection method has a poor signal to noise ratio, and the electrical resistance method is subject to lime buildup, electrode corrosion, and the conductivity variation of supply water.

It is an object of this invention to provide a system for reliably detecting the formation of ice on a cold surface within an automatic ice maker that avoids the aforementioned problems of mechanical detection apparatus, thermal detection apparatus and electrical resistance detection apparatus.

SUMMARY OF THE INVENTION

The above and other objects are achieved by mounting an electrode at a predetermined distance from an ice forming cold surface. The electrode is part of a capacitance sensing circuit which senses the capacitance of a capacitor formed by the electrode and the cold surface wherein the dielectric therebetween may be a combination of air, water and ice. When the dielectric primarily becomes ice as the result of the formation of ice on the cold surface, then the rate of charge or discharge of the formed capacitor becomes very distinct from the situation when any air gap is present between the electrode and the cold surface. This predictable change in the capacitance of the thus formed capacitor can be used to indicate the presence of ice between the electrode and the cold surface. This, for instance, can be used to signal the ice making machine to harvest the built up ice cubes.

In a preferred embodiment, the dielectric property of the medium between the sensor and the cold surface is detected by an operational amplifier configuration that cycles high and low depending on the charge and discharge characteristics of the capacitor formed between the mounted electrode and the cold surface. The frequency at which the operational amplifier configuration cycles from high to low and back to high again will vary with the amount of ice that has been formed on the cold surface. In particular, the amplifier configuration will produce an output signal having a predictable frequency when ice has built up on the cold surface and the ice source water bridges the gap between ice and sensing electrode. The water between ice and electrode serves as either a conducting extension of the electrode or as part of a composite dielectric with the ice depending on the purity of the water. In either event capacitance between electrode and cold surface is greatly increased over that of air. The amplifier configuration will produce a frequency output which will become considerably lower. The occurrence of this lowered frequency can be used as a means for electronically detecting formation of a given amount of ice formed on the cold surface.

BRIEF DESCRIPTION OF THE DRAWINGS

Other objects and advantages of the present invention will be apparent from the following description in conjunction with the accompanying drawings, in which.

DESCRIPTION OF THE PREFERRED EMBODIMENT

Figure 1:
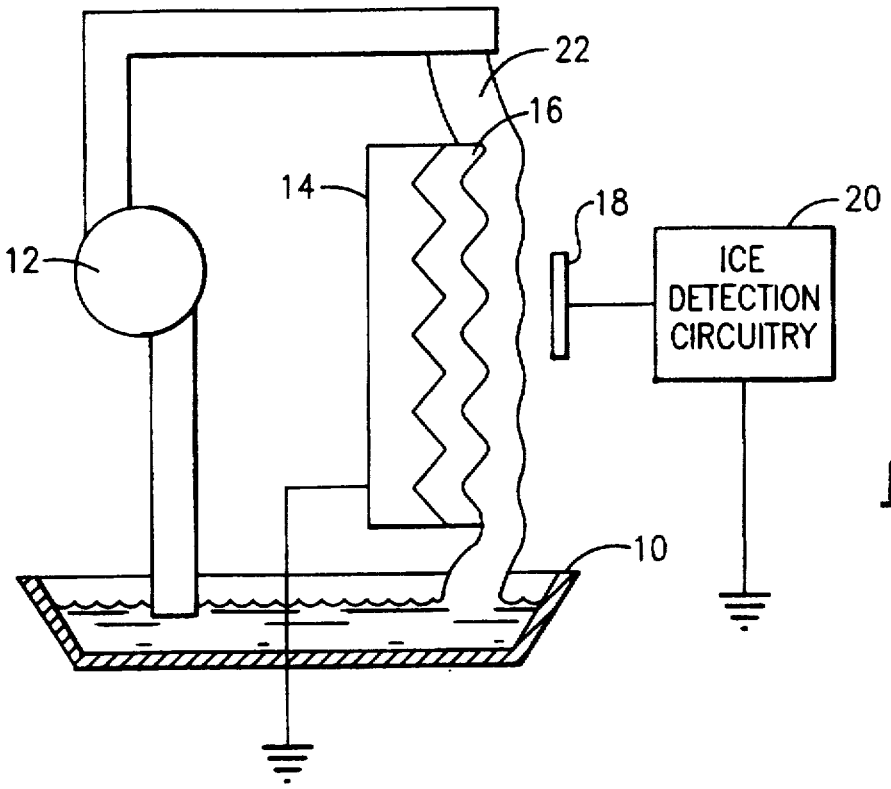
FIG. 1 illustrates an ice making machine having a cold plate upon which ice may be formed.

Referring to FIG. 1, an ice making machine is schematically depicted as including a water reservoir 10 from which water is pumped via a pump 12 to a position above a cold plate 14. The cold plate 14 is maintained at a below freezing temperature so as to cause a thickness of ice 16 to form on the cold plate 14 when water from the pump 12 flows down over the cold plate. The cold plate 14 is appropriately formed in the shape of the ice that is to be harvested from the ice making machine. A metal plate 18 associated with ice detection circuitry 20 is positioned near the cold plate 14 at a distance equal to the thickness of the ice that will occur at the time it is to be harvested plus the thickness of the ice-source flowing water 22 occurring at that time. It is to be appreciated that the thickness of the ice 16 and the flowing water 22 as shown in FIG. 1 is not what will occur at ice harvest time. In this regard, the thickness of ice will have increased by ice harvest time so that the flowing water will have made appropriate electrical contact with the plate 18.

Figure 2:
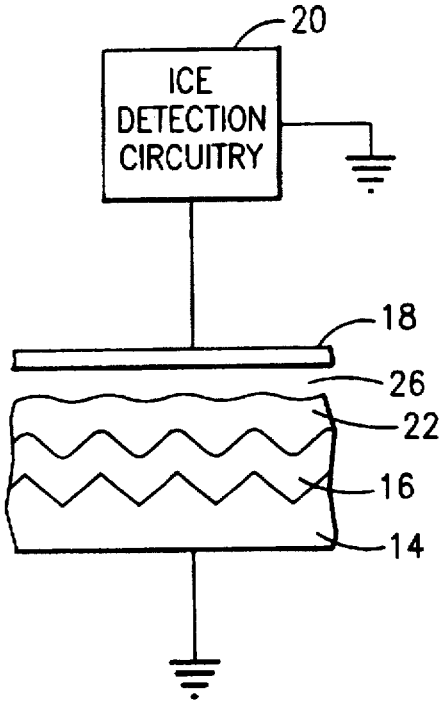
FIG. 2 is a schematic view of a capacitor formed by the cold plate and an electrode positioned in proximity to the cold plate surface of FIG. 1.

Referring to FIG. 2, the medium between the metal plate 18 and the cold plate 14 is schematically illustrated. In particular, the medium is seen to consist of the thickness of ice 16 formed on the cold plate 14 together with the thickness of water 22 flowing over the formed ice. There is finally a space 26 consisting of the air between the metal plate 18 and the flowing water 22. As will be explained hereinafter, the metal plate 18 functions as an electrode of a capacitor that comprises a dielectric medium consisting of the respective amounts of ice, water, and air between the metal plate 18 and the cold plate 14. Both the metal plate 18 and the cold plate 14 must be sufficiently electrically conductive so as to function as electrodes within the capacitor configuration. The cold plate 14 is moreover preferably grounded so as to form an appropriate circuit path for the application of various voltage conditions by the ice detection circuitry 20 as will be hereinafter described.

Referring to the metal plate 18, it is to be noted that this plate may be coated with a thin layer of teflon or other electrically insulative material. Such a coating will prevent direct metal contact with the flowing water. The addition of such a thin layer of insulative material will, of course, result in another element being introduced into the dielectric medium between the metal plate 18 and the cold plate 14. This can be tolerated as long as the thickness of the insulative layer is small relative the other dielectric media so as to not significantly impact the capacitive characteristics of the dielectric media being measured.

Figure 3:
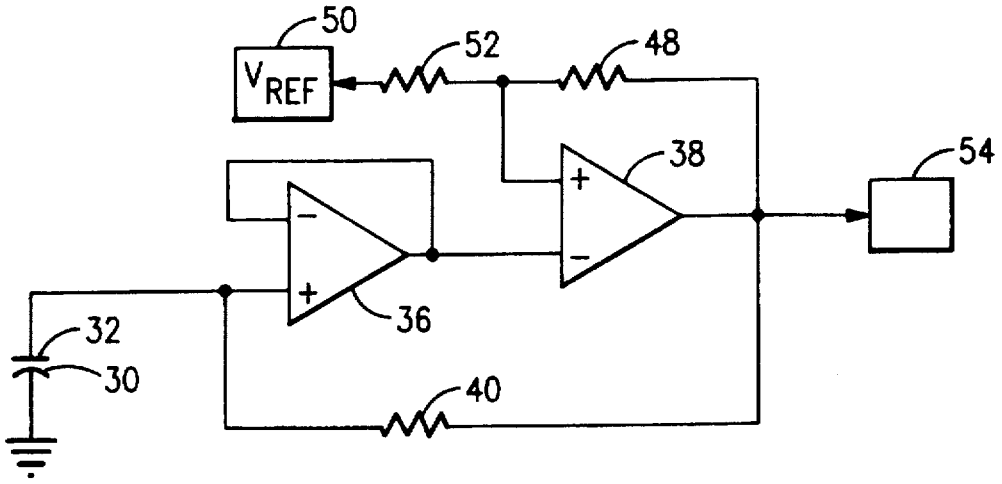
FIG. 3 illustrates ice formation detection circuitry associated with the electrode positioned in proximity to the cold surface of FIGS. 1 and 2.

Referring to FIG. 3, the capacitor formed by the metal plate 18 and the cold plate 14 with the various medium components therebetween is illustrated as a variable capacitance capacitor 30. As call be seen, one electrode of the capacitance is grounded by virtue of the cold plate 14 of FIGS. 1 and 2 being grounded. The opposing electrode 32 of the capacitor 30 is the conductive metal plate 18 which receives a voltage condition from upstream circuitry.

The metal plate 18 forming the upstream electrode 32 of the capacitance 30 is normally electrically connected to a noninverting input of an operational amplifier 36.

The operational amplifier 36 is configured as a voltage follower to present a very high impedance to the variable capacitance 30 and a low impedance drive to an operational amplifier 38. The output of the operational amplifier 38 causes the variable capacitance 30 to either charge or discharge. In this regard, a high voltage output of the operational amplifier 38 causes the variable capacitance 30 to charge by virtue of a current path through a resistor 46.

The output of the operational amplifier 38 is fed back through a resistor 48 to the noninverting input of this amplifier. The noninverting input is also subject to a reference voltage source 50 having a value between ground and the high voltage output of the amplifier 38 as reduced by a resistor 52.

It is to be appreciated that the output of the operational amplifier 38 will fluctuate between a low voltage level and a high voltage level. This will cause the voltage at the noninverting input of the operational amplifier 38 to vary between a low limit and a high limit depending on the values of resistors 48 and 52, the reference voltage $V_R$, and the particular high and low voltage level values.

Figure 4:
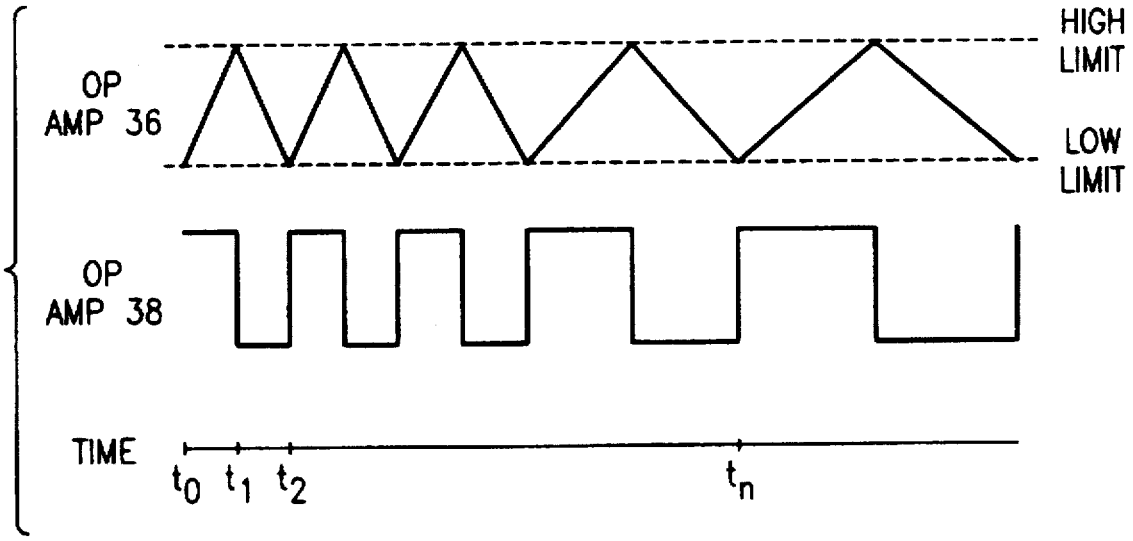
FIG. 4 illustrates signals present within the ice formation detection circuitry of FIG. 3.

Referring now to FIG. 4, the analog voltage output of the operational amplifier 36 and the square wave output of the operational amplifier 38 are both illustrated. These signals are illustrated relative to a time line as shown. Referring to the output signal of the operational amplifier 36, as has been previously discussed, this amplifier should be a follower of the changing voltage on the variable capacitance capacitor 30.

Accordingly, the output signal of the operational amplifier 36 rises when the variable capacitance capacitor 30 charges due to the output voltage from the operational amplifier 38 being high at a time $t_0$. At time $t_1$, the output voltage of the operational amplifier 36 as applied to the inverting input of the operational amplifier 38 rises to the high voltage limit applied to the noninverting input of the operational amplifier 38. This will cause the output of the operational amplifier 38 to switch low which further lowers the reference voltage applied to the noninverting input of operational amplifier 38. The resulting low voltage at the output of the operational amplifier 36 causes the variable capacitance capacitor 30 to discharge through resistance 40. This prompts the output of the operational amplifier 38 to begin to decrease in value due to the discharging of the variable capacitor 30. When the voltage output of the operational amplifier 36 falls below the low voltage imposed on the noninverting input of the operational amplifier 38, the operational amplifier 38 will switch high again as denoted at time $t_2$. It is hence to be appreciated that the charging and the discharging of the variable capacitance capacitor 30 as reflected in the voltage following operational amplifier 36 defines a complete cycle of the square wave output of the operational amplifier 38. Since the charging and discharging times of the variable capacitor 30 are a direct function of the absolute value of the capacitance of the capacitor 30, the frequency with which the operational amplifier 38 output cycles from high to low and back to high again will be an inverse function of such capacitance. This frequency as measured at the output of the operational amplifier 38 can be used to predict the formation of a predetermined amount of ice between the electrodes.

Referring to the signals of FIG. 4, as ice is formed between the electrodes of the capacitor 30, the dielectric constant of the ice between the electrodes will increase leading to a slower charging and discharging capacitor. This is illustrated by the changing cyclical period of the square wave output of the operational amplifier 38. At some time $t_n$, sufficient ice will have formed between the electrodes of the capacitor 30 so as to produce an identifiable frequency at the output of the operational amplifier 38. The occurrence of this frequency can be detected by a frequency sampler device 54 so as to predict the formation of a given amount of ice. The frequency sampler circuit could be a programmed computer responsive to the square wave signal from the operational amplifier 38 or it could be a dedicated sampling circuit responsive only to the particular frequency. In either event, the particular detected frequency can signal an ice cube forming device to release the thus formed ice cubes.

It is to be appreciated that a particular embodiment of the invention for use in an ice making machine has been described. Alterations, modifications and improvements thereto will readily occur to those skilled in the art. For instance, the circuitry of FIG. 3, which produces a measurable frequency that can be used to detect the presence of ice, can be replaced with circuitry providing another form of measuring of the change in the dielectric constant of the variable capacitance 30 so as to thereby predict the formation of ice. It is also to be appreciated that the invention may be used to detect the formation of ice on a cold surface other than in ice making machines. Accordingly, the foregoing description is by way of example only and the invention is to be limited by the following claims and equivalents thereto.

What is claimed is:

1. A system for detecting the formation of ice on a cold surface, said system comprising:

a conductive plate positioned opposite said cold surface; and circuitry connected to said conductive plate for detecting the presence of ice formed on said cold surface by noting changes in the capacitance of a capacitor formed by said conductive plate, said cold surface, and a dielectric medium therebetween wherein the dielectric medium may at some point substantially comprise the ice formed on said cold surface, and further wherein the dielectric medium comprises ice source water bridging a gap formed between said conductive plate and the ice formed on said cold surface.

2. The system of claim 1 wherein said circuitry connected to said conductive plate comprises:

circuitry for applying at least one voltage condition across the formed capacitor and noting the responsiveness of the formed capacitor to the applied voltage condition.

3. The system of claim 2 wherein said circuitry connected to said conductive plate furthermore comprises:

at least one amplifier for amplifying the response of the formed capacitor to the applied voltage condition so as to thereby produce a signal which may be analyzed to determine the capacitance characteristics of the dielectric medium between the conductive plate and the cold surface.

4. The system of claim 3 further comprising:

a frequency sampler device for sampling the frequency of the signal from said amplifier and noting when a sampled frequency indicates that a particular amount of ice has at least been formed between the conductive plate and the cold surface thereby producing the capacitor characteristics of the formed capacitor that result in the output signal.

5. The system of claim 1 wherein said circuitry connected to said conductive plate comprises:

a first amplifier operatively connected to said conductive plate so as to respond to the voltage present at the conductive plate;

a second amplifier having an input connected to the output of said first amplifier and furthermore having an output operatively connected through at least one resistor to the conductive plate so as to define an electrical current path between the conductive plate and the output of said second amplifier.

6. The system of claim 5 further comprising:

a frequency sampler device connected to the output of said second amplifier for sampling the frequency of the output signal from said second amplifier and noting when a sampled frequency indicates that a particular amount of ice has at least been formed between the conductive plate and the cold surface thereby producing the capacitive characteristics of the formed capacitor that result in the particular sampled frequency in the output signal.

7. A process for detecting the formation of ice on a cold surface, said process comprising the steps of:

forming a capacitor wherein a first electrode of the capacitor consists of a plate positioned above the cold surface and wherein the second electrode of the capacitor comprises the cold surface and wherein the dielectric medium between the electrodes may substantially include ice formed on the cold surface, and wherein the dielectric medium further includes ice source water bridging a cap formed between the plate and the ice formed on the cold surface;

applying at least one voltage condition across the formed capacitor;

measuring the responsiveness of the formed capacitor to the at least one voltage condition applied across the formed capacitor; and determining whether the responsiveness of the formed capacitor is indicative of a particular amount of ice having been formed between the plate and the cold surface.

8. The process of claim 7 wherein said step of measuring the responsiveness of the formed capacitor to the at least one voltage condition applied across the capacitor comprises:

amplifying the response of the formed capacitor to the at least one applied voltage condition so as to thereby produce a signal which may be analyzed to determine the capacitance characteristics of the dielectric medium between the plate and the cold surface.

9. The process of claim 8 wherein said step of determining whether the responsiveness of the formed capacitor is indicative of a particular amount of ice having been formed between the plate and the cold surface comprises:

sampling the frequency of the signal resulting from amplifying the response of the formed capacitor; and noting when the sampled frequency of the signal indicates that a particular amount of ice has at least been formed between the plate and the cold surface so as to produce a capacitance in the formed capacitor that results in the sampled frequency.

10. The process of claim 7 wherein said step of applying at least one voltage condition across the formed capacitor comprises the steps of:

establishing a first voltage condition causing the capacitor formed between the electrode and the cold surface to charge; and establishing a second voltage condition causing the capacitor formed between the electrode and the cold surface to discharge.

11. The process of claim 10 wherein said step of measuring the responsiveness of the formed capacitor to the at least one voltage condition applied across the capacitor comprises:

amplifying the response of the formed capacitor to the first and second voltage conditions so as to thereby produce a signal illustrative of the charging and discharging of the capacitor which may be analyzed to determine the capacitance characteristics of the dielectric medium between the plate and the cold surface.

12. The process of claim 11 wherein said step of determining whether the responsiveness of the formed capacitor is indicative of a particular amount of ice having been formed between the plate and the cold surface comprises:

sampling the frequency of the signal resulting from amplifying the response of the formed capacitor; and noting when the sampled frequency of the signal indicates that a particular amount of ice has at least been formed between the plate and the cold surface so as to produce a capacitance in the formed capacitor that results in the sampled frequency.

13. A process for detecting the formation of ice on a cold surface comprising the steps of:

subjecting an electrode positioned opposite said cold surface to a particular set of voltage conditions;

sensing the responsiveness of a capacitor formed between the electrode and the cold surface to the particular set of voltage conditions; and determininig whether the responsiveness of the capacitor formed between the electrode and the cold surface is indicative of ice having been formed between the electrode and the cold surface, and further indicative of ice source water bridging a gap formed between the ice and electrode.

14. The process of claim 13 wherein said step of measuring the responsiveness of the formed capacitor to at least one voltage condition comprises:

applying a first voltage across the formed capacitor followed by the application of a second voltage condition across the formed capacitor; and measuring the responsiveness of the formed capacitor to the successively applied voltages across the formed capacitor.

15. The process of claim 14 wherein said step of determining whether the responsiveness of the capacitor formed between the electrode and the cold surface is indicative of ice having been formed comprises:

determining whether the combination of charging and discharging of the capacitor is indicative of ice being the principal dielectric medium between the electrode and the cold surface.

* * * * *